United States Patent [19]

Hagermo

[11] 4,077,691

[45] Mar. 7, 1978

[54] CONTACT DEVICE

[75] Inventor: Kjell Gustaf Roland Hagermo, Skärholmen, Sweden

[73] Assignee: Telefonaktiebolaget L M Ericsson, Stockholm, Sweden

[21] Appl. No.: 710,913

[22] Filed: Aug. 2, 1976

[30] Foreign Application Priority Data

Sep. 5, 1975 Sweden ..... 7509869

[51] Int. Cl.[2] ..... H01R 9/10

[52] U.S. Cl. ..... 339/95 R; 339/263 R

[58] Field of Search ..... 339/95 R, 95 A, 263 R

[56] References Cited

U.S. PATENT DOCUMENTS

| | | | |
|---|---|---|---|
| 3,340,494 | 9/1967 | Gutshall | 339/95 A |
| 3,535,673 | 10/1970 | Maltais | 339/95 R |

FOREIGN PATENT DOCUMENTS

| | | | |
|---|---|---|---|
| 1,195,841 | 7/1965 | Germany | 339/95 R |

OTHER PUBLICATIONS

Abbatccola, Connectors, IBM Technical Disclosure Bulletin, vol. 10, No. 10, Mar. 1968, p. 1462.

*Primary Examiner*—Joseph H. McGlynn
*Assistant Examiner*—Mark S. Bicks
*Attorney, Agent, or Firm*—Hane, Roberts, Spiecens & Cohen

[57] ABSTRACT

Contact device for achieving an electric conducting connection between a metallic plate and another metallic object, for instance between a plug-in unit and a rack, where a connection plate fastened to the metallic plate has on one side edges known per se and is so bent that the edges, when the contact device is inactive, are withdrawn inside the surface of the metallic plate facing the metallic object, and that the edges, owing to pressure from a fastening element inserted through the contact device, can be brought to protrude from the surface of the metallic plate.

4 Claims, 5 Drawing Figures

CONTACT DEVICE

BACKGROUND OF THE INVENTION

The present invention relates to a contact device for achieving an electric conducting connection between a metallic plate and another metallic object.

Where plug-in units are placed in racks, the problem arises that the units are to be put in conducting connection with the racks in order to allow earth currents to be conducted from the units to the earthed racks. A hitherto used kind of such connection has been wires with cable clips arranged between the plug-in unit and the rack which are fastened with screws at the unit and at the rack. Another kind has been special pins and sockets assigned for earthing which are inserted into each other when the unit is put in its place in the rack; the pin and the socket are connected with wires to the unit and to the rack. A third kind of connection has been a toothed washer positioned between the plate housing of the plug-in unit and the plates of the racks. Through this toothed washer a fastening screw is applied which holds the unit in place in the rack. The contact device according to the invention is a development of the connection with the toothed washer.

SUMMARY OF THE INVENTION

With the contact device according to the invention, there is achieved, among other things, the advantage before the connection with a toothed washer that the contact device is firmly attached to the plug-in unit so that it always is at hand in the right place and that its design prevents scratches on the plate of the rack when the unit is inserted into the rack.

BRIEF DESCRIPTION OF THE DRAWING

In the following, an example of a contact device according to the invention is described, whereby it is referred to the accompanying drawing where.

DETAILED DESCRIPTION OF THE INVENTION

Figure 1:
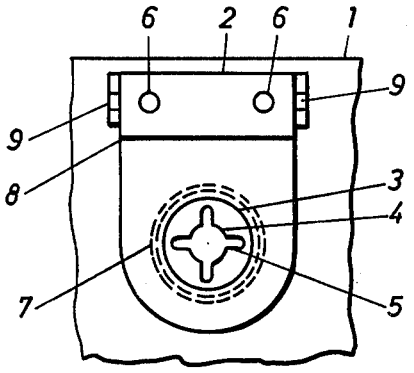
FIG. 1 and FIG. 2 show the contact device in plan view and side view.
Figure 2:
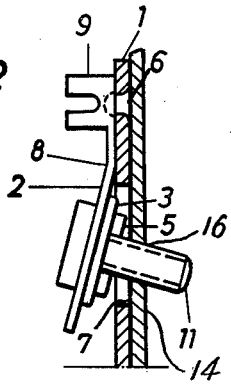

The contact device consists essentially, as appears from FIG. 1 and FIG. 2, of a connection plate 2 mounted on a plate 1 included in a plug-in unit. The connection plate has a circular hollow protrusion or embossing 3 in the middle of which a hole 4 is provided. Radially from the hole four ribs or punchings radiate, the rims of which are formed to edges 5. The connection plate 2 is fastened to the plate 1 with two rivets 6 in such a manner that the embossing 3 is concentric with a hole 7 in the plate 1, which hole is somewhat larger than the embossing.

The connection plate 2 has formed, close to its fastening site, a bending 8 whereby the edges 5 are somewhat raised out from the hole 7 in the plate 1. The connection plate 2 further has two perpendicularly bent soldering tags 9 for soldering wires to such devices placed in the plug-in unit which are to be grounded.

Through the hole 4 in the connection plate 2 a fastening element 11, in the form of a screw with cylindric head, is inserted; the hole 4 for the screw is a clearance hole.

Figure 3:
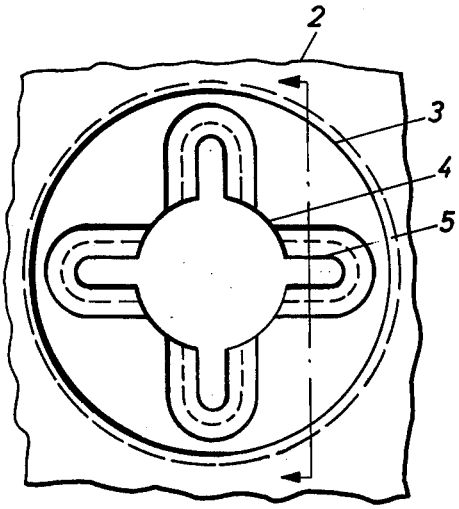
FIGS. 3 and 4 show an enlargement of a detail of the device in plan view and side view and FIG. 5 shows a variant of the contact device.
Figure 4:
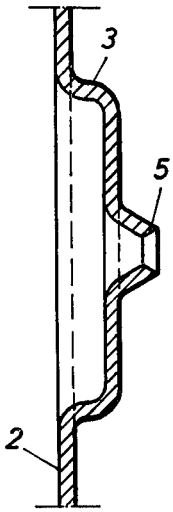

Details of the design of the circular protrusion or embossing 3 and the edges 5 are shown enlarged in FIG. 3. A cut through the edges is shown in FIG. 4. The circular protrusion or embossing 3 has such an inner diameter that it can hold the head of the screw 11. The ribs or punchings radiating from the hole 4 have their burr left for the sharpest possible edges 5.

In a plug-in unit, normally a number of fastening screws, for instance 2 or 4, are surrounded by the described connection plate 2. When the unit is inserted into a rack 14, the edges 5 of the connection plate 2, owing to the bending 8 of the plate are, drawn inside the outer surface of the plate 1 of the unit, which means that damage to the inner walls of the rack 14 owing to scratching by the edges 5 are completely avoided. When the unit is put in its place in the rack 14, the screw 11 is inserted through the hole 4 of the connection plate 2, is screwed into a threaded hole 16 in the rack wall, and is tightened. At the tightening, the head of the screw presses on the connection plate 2, so that this becomes flat and flush with the underlying plate 1, whereby the edges 5 protrude through the hole 7 and penetrate and make contact with the metal in the rack wall (metallic object). The material of the rack wall is to be the greatest part aluminium plate; it may occur that a bar of copper is applied on the rack wall where the contact device is to make contact with this.

The connection plate 2 in the described example is made of a tinplated copper plate with a thickness of 0.5 mm. The total width of the plate is 17 mm and the hole 4 for the screw 11 has a diameter of 5.4 mm.

Figure 5:
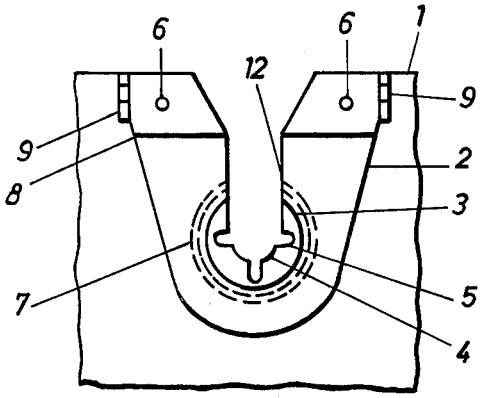

A variant of the contact device according to the invention is achieved with a groove 12, which reaches from the edge of the connection plate 2 at the fastening site to its hole 4. The edges of the groove are in the main parallel, but in the outer part of the groove the edges diverge. In the plate 1, under the connection plate 2, a groove is also made which completely coincides with the groove 12 in the connection plate. As in the first described contact device, the plate 1 has a hole 7 which is concentric with the protrusion or embossing 3 of the connection plate 2. The design of the variant is shown in FIG. 5.

We claim:

1. A contact assemblage comprising: a metallic object; a metallic plate abutting said metallic object; a connection plate having a first portion parallel with and fixed to a portion of said metallic plate and a second portion integrally connected to said first portion and extending at an angle away from said metallic plate, said connection plate having a protrusion projecting from said second portion, said protrusion having a first hole formed centrally thereof and a plurality of ribs extending radially outwardly from said first hole, said protrusion and said ribs extending toward said metallic plate, said metallic plate having a second hole formed therethrough in alignment with said first hole formed in said protrusion, said second hole being of a larger diameter than the diameter of said protrusion so that a portion of said protrusion and a portion of said ribs extend partially into said second hole before operative connection between said ribs and said metallic object; and means for alternately bending said second portion of said connection plate toward said metallic plate and said metallic object in order to align said first and second portions, whereby upon bending of said second portion by said means said ribs extend through said second hole and abut against said metallic object to make electrical contact therewith.

2. The contact assemblage according to claim 1, wherein said means comprises a fastening element insertable through said first hole, said metallic object having a third hole formed therein for receiving therein said fastening element, whereby said second portion may be alternately bent and unbent by said fastening element to bring said ribs into and out of contact with said metallic object.

3. The contact assemblage according to claim 2, wherein said fastening element comprises a screw having an enlarged head, and said third hole is threaded, said enlarged head having a larger diameter than the diameter of said first hole.

4. The contact assemblage according to claim 2, wherein there are four of said ribs spaced symmetrically about said first hole, each of said ribs also having sharpened edges formed thereon forwardmost of said protrusion for abutting against said metallic object.

* * * * *